US006944950B1

(12) United States Patent
Watson, III et al.

(10) Patent No.: US 6,944,950 B1
(45) Date of Patent: Sep. 20, 2005

(54) TOWER REINFORCEMENT APPARATUS AND METHODS

(76) Inventors: Thomas B. Watson, III, 3010 E. Kingsfield Rd., Pensacola, FL (US) 32514; Thomas B. Watson, Jr., 132 Highland Trace Dr., Baton Rouge, LA (US) 70810

( * ) Notice: Subject to any disclaimer, the term of this patent is extended or adjusted under 35 U.S.C. 154(b) by 2 days.

(21) Appl. No.: 10/444,264

(22) Filed: May 23, 2003

Related U.S. Application Data

(63) Continuation-in-part of application No. 10/288,055, filed on Nov. 5, 2002.

(51) Int. Cl.[7] ..... B21K 23/00; E04H 12/00

(52) U.S. Cl. ..... 29/897.31; 29/897.3; 29/897.31; 52/651.1; 52/651.01; 52/745.04; 52/146

(58) Field of Search ..... 52/651.02, 651.1, 52/652.1, 651.01, 651.03, 651.07, 651.09, 52/745.04, 745.18, 146, 223.4, 223.8, 223.9, 52/649.2; 29/897.3, 897.31, 897.312, 897.34, 29/446, 452

(56) References Cited

U.S. PATENT DOCUMENTS

| | | | | |
|---|---|---|---|---|
| 919,771 | A * | 4/1909 | Roberts | 52/152 |
| 1,658,535 | A * | 2/1928 | Neilson, Sr. | 52/223.4 |
| 1,693,107 | A * | 11/1928 | Campbell | 52/638 |
| 4,216,636 | A * | 8/1980 | Cordell | 52/637 |
| 4,231,200 | A * | 11/1980 | Henderson | 52/111 |
| 6,108,996 | A | 8/2000 | McGinnis | |
| 6,694,698 | B2 * | 2/2004 | Ryan | 52/741.1 |

* cited by examiner

*Primary Examiner*—Marc Jimenez
(74) *Attorney, Agent, or Firm*—Kenneth W. Float

(57) ABSTRACT

An apparatus for reinforcing at least one load-bearing section of a tower assembly which apparatus includes two leg members, at least one brace member for connection to both of the leg members, and at least one connecting plate for attachment to a respective flange plate of the section of the tower assembly and for attachment to an end of one of the leg members, which flange plate is attached to or integral with the section of the tower assembly. The apparatus components form a reinforcing panel which is attachable to the load-bearing section of the tower assembly, so that the two leg members bear at least a portion of the section load when the panel is attached. The apparatus may include adjustable length leg members which enable the length of the panel to be adjusted and at least a portion of the section load to be transferred to the legs.

17 Claims, 9 Drawing Sheets

TOWER REINFORCEMENT APPARATUS AND METHODS

REFERENCE TO RELATED APPLICATION

This is a continuation-in-part of commonly-owned and co-pending U.S. patent application Ser. No. 10/288,055, filed on Nov. 5, 2002, the entire disclosure of which is incorporated herein by reference.

TECHNICAL FIELD

This invention relates to apparatus and methods for reinforcing tower structures.

BACKGROUND

Existing towers, including, but not limited to, guy-wired or self-supporting towers for supporting communication devices and antennas, may require reinforcing due to weakening over time or the desire to enable additional load-bearing capabilities. When the term "load" is used herein, it is understood to mean shear forces from wind and compression in addition to the weight that is supported by a structure. Typically, each tower has its own foundation and multiple legs which are spliced together at convenient intervals, with diagonal and horizontal cross-braces interspersed between the legs. The splice connections for each tower section typically are constructed in one of two ways. The first type of splice connection is accomplished using abutting flange plates having matching bolt hole placements. The second type of splice connection, used for those towers having tubular legs, incorporates a telescoping connection of the two tubular legs, where the end of one leg in cross-section is reduced so that it fits inside the corresponding leg in order that matching bolt holes can be aligned for connecting the two legs.

A way of increasing the structural integrity and capability of existing towers in lieu of replacing the towers entirely is desirable. Previous attempts to bolster existing tower structures have provided augmentation legs which are installed on the exterior of existing tower legs, but may require an additional support base or foundation. Such retrofitting requires that holes be drilled in existing tower legs to accommodate attachment of an augmentation tower to the existing tower. In such a structure, addition of such devices as antenna to the intermediate tower structure is impaired by the location of the augmentation tower legs. Thus, a need exists for an apparatus and method for reinforcing an existing tower structure that does not require structural modification such as drilling into existing tower legs and allows continued access to existing tower legs.

SUMMARY OF THE INVENTION

This invention is deemed to fulfill these and other needs by providing, among other things, a reinforcement apparatus which is attachable without welding or drilling structures of the existing tower, since such actions could be time-consuming and awkward. A further advantage of the reinforcing apparatus of the invention, once installed, allows continued access to the existing tower legs so that later attachment of communication devices would not be impeded. Support and strengthening of the existing tower is accomplished without the need for additional foundation structures as long as the existing foundation can support the structure as supplemented. While an embodiment of the invention accomplishes the reinforcement process completely on site, the apparatus of the invention can be partially assembled in another location before final installation in the field.

One embodiment of the invention provides an apparatus for reinforcing one or more load-bearing sections of a tower assembly. The apparatus comprises (A) two leg members, (B) a plurality of brace members, sized and configured for connection to both of the leg members, and (C) at least one connecting plate sized and configured for attachment to a respective flange plate of the section of the tower assembly and for attachment to an end of the leg member, which flange plate is attached to or integral with the section of the tower assembly. The leg members, plurality of brace members and at least one connecting plate are sized and configured for attachment to one another to form a panel or a plurality of panels, such that the two leg members bear at least a portion of the section load when installed.

Another embodiment of the invention comprises a method for reinforcing one or more load-bearing sections of a tower assembly. The method comprises (1) assembling a reinforcing panel having a vertical measure less than the vertical measure of the tower assembly section to be reinforced, which panel comprises (i) two leg members, (ii) a plurality of brace members sized and configured for connection to both of the leg members, and (iii) at least one connecting plate, sized and configured for attachment to a respective flange plate of the section of the tower assembly and for attachment to an end of the leg member, which flange plate is attached to or integral with the section of the tower assembly, (2) positioning the panel in close proximity to a respective one of the one or more sections of the tower assembly, such that the connecting plate is adjacent to a flange plate of the respective section, (3) transferring at least a portion of the section load to each leg member, and (4) attaching the connecting plate to the flange plate.

Another embodiment of the invention provides a method for reinforcing one or more load-bearing sections of a tower assembly. The method comprises: (1) positioning a reinforcing panel having a vertical measure less than the vertical measure of the tower assembly section to be reinforced, into close proximity to a flange plate of the section of the tower assembly, which panel comprises (i) two leg members, (ii) a plurality of brace members connected to and extending between both of the leg members, and (iii) a plurality of connecting plates, each plate connected to the end of a respective leg and sized and configured for attachment to a respective flange plate of the section of the tower assembly, which flange plate is attached to or integral with the section of the tower assembly, (2) positioning the panel in close proximity to the section of the tower assembly, such that the connecting plate is adjacent to a flange plate of the section of the tower assembly, (3) transferring at least a portion of the section load to each leg member, and (4) attaching the connecting plate to the flange plate.

In another embodiment of this invention a method for reinforcing one or more load-bearing sections of a tower assembly is provided. The method comprises (A) attaching a respective support panel to each side of the one or more load-bearing sections at one or more respective flange plates, which flange plates are attached to or integral with the one or more tower sections, so that at least a portion of the load is transferred to the respective panel, and (B) attaching each of the respective support panels to one or more adjacent support panels.

Yet another embodiment of this invention provides apparatus comprising (A) two leg members, (B) at least one brace member sized and configured for connection to both of the leg members, and (C) at least one connecting plate sized and configured for attachment to a respective flange plate of the section of the tower assembly and for attachment to an end of one of the leg members, the flange plate being attached to or integral with the section of the tower assembly. The leg members, brace member and connecting plate are sized and configured to form a panel which is attachable to the load-bearing section of the tower assembly, so that the two leg members bear at least a portion of the section load when the panel is attached to the load-bearing section of the tower assembly. Another embodiment of the invention provides apparatus as stated in the two preceding sentences, wherein the length of the panel is adjustable.

Another embodiment of the invention provides apparatus comprising three panels for each section of the tower assembly, each panel being comprised of: (A) two leg members, (B) a plurality of brace members sized and configured for connection to both of the leg members, and (C) four connecting plates attached respectively to each end of each leg member, each of the connecting plates being sized and configured for attachment to a respective flange plate of the respective section of the tower assembly, the flange plate being attached to or integral with the section of the tower assembly. Each panel is attached to the load-bearing section at a respective face of the load-bearing section of the tower assembly, so that the leg members bear at least a portion of the section load when the panels are attached to the load-bearing section of the tower assembly.

Still another embodiment of this invention is a method for reinforcing one or more load-bearing sections of a tower assembly. The method comprises:

(1) assembling a reinforcing panel having an adjustable vertical measure which may be less than the vertical measure of the tower assembly section to be reinforced, which panel comprises (i) two leg members, (ii) at least one brace member sized and configured for connection to both of the leg members, and (iii) at least one connecting plate, sized and configured for attachment to a respective flange plate of the tower assembly and for attachment to an end of the leg member, which flange plate is attached to or integral with the section of the tower assembly, (2) positioning the panel in close proximity to a respective one of the one or more sections of the tower assembly, such that the connecting plate is adjacent to a flange plate of the respective section, (3) lengthening the panel to thereby transfer at least a portion of the section load to each leg member, and (4) attaching the connecting plate to the flange plate.

Another embodiment of the invention provides a method for reinforcing one or more load-bearing sections of a tower assembly, which method comprises:

(1) positioning a reinforcing panel having an adjustable vertical measure which may be adjusted to be less than the vertical measure of the tower assembly section to be reinforced, into close proximity to a flange plate of the section of the tower assembly, which panel comprises (i) two leg members, (ii) a plurality of brace members connected to and extending between both of the leg members, and (iii) a plurality of connecting plates, each plate connected to the end of a respective leg and sized and configured for attachment to a respective flange plate of the section of the tower assembly, which flange plate is attached to or integral with the section of the tower assembly, (2) positioning the panel in close proximity to the section of the tower assembly, such that the connecting plate is adjacent to a flange plate of the section of the tower assembly, (3) transferring at least a portion of the section load to each leg member, and (4) attaching the connecting plates to their respective flange plates.

These and other embodiments and features of the invention will become still further apparent from the ensuing drawings, description and appended claims.

BRIEF DESCRIPTION OF THE DRAWINGS

In each of the above figures, like numerals are used to refer to like or functionally like parts among the several figures.

DETAILED DESCRIPTION OF THE INVENTION

While apparatus of this invention can be utilized to reinforce towers having a plurality of leg members and multiple vertical sections, the Figures herein depict a preferred embodiment of this invention supporting a tower having three leg members and therefore three sides or faces. Other embodiments could be used to support towers having 4 or more leg members. The Figures are merely illustrative and are not intended to limit the scope of the claimed invention.

Figure 1:
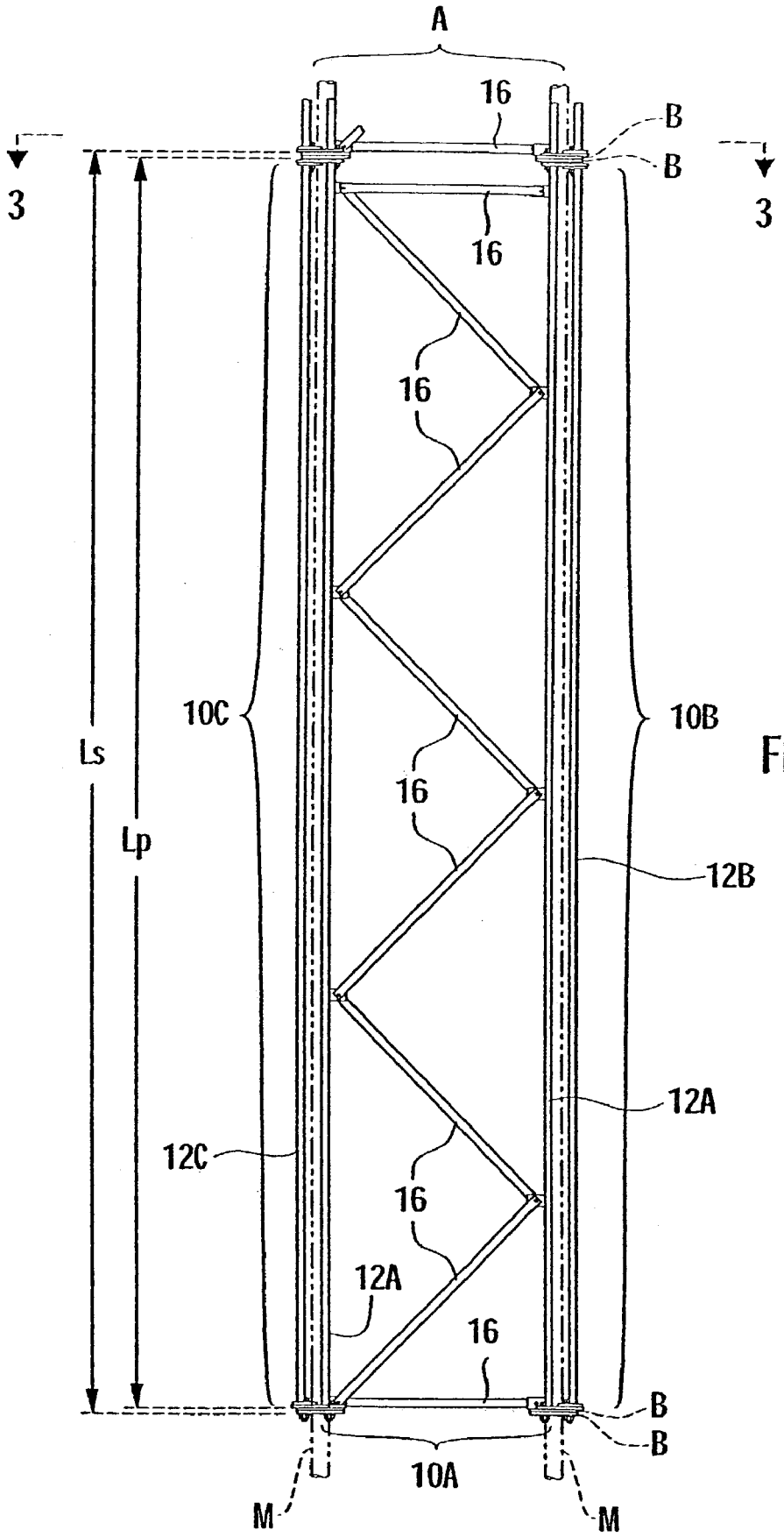
FIG. 1 is an elevated phantom view of a section of a guyed tower reinforced by a preferred embodiment of this invention.

FIG. 1 illustrates one embodiment of this invention. The apparatus reinforces one or more load-bearing sections of a tower assembly. A section A of the tower assembly is shown with a panel 10A of the apparatus assembled and attached to tower section A. Panel 10A is comprised of leg members 12A, 12A which are aligned substantially parallel to vertical members M, M of tower section A.

As may be seen, FIG. 1 only presents leg members 12B and 12C of other panels 10B and 10C which are not visible in their entirety. Panel 10A further comprises brace members 16, 16, shown in horizontal and diagonal alignment so that brace members 16, 16 further connect and strengthen panel 10A. Corresponding braces of the existing tower section A are not shown. Tower section length Ls is shown as is panel length Lp. In the preferred embodiment depicted, panel length Lp is less than but substantially the same as tower section length Ls. The phrase, "substantially the same," as used herein with reference to the length of the panel means that the difference between tower section length Ls and panel length Lp is relatively small compared to panel length Lp. In particularly preferred embodiments, the difference is in the range of about 0.25 to about 1.25 inches (0.64 cm to 3.18 cm) and more preferably about 0.5 inches (1.27 cm). This slightly shorter length of panel length Lp allows for ease of installation of panel 10A and transfer of at least a portion of the load of tower assembly A to leg members 12A, 12A when apparatus of the invention is installed. Preferably the length of panel Lp is tower section length Ls minus twice the thickness of flange plate B of tower section A, calculated according to the formula:

$$Lp<Ls-2(\text{thickness of } B)$$

Panel 10A, as seen installed to reinforce section A of the tower assembly, is a trussed tower strengthening panel built from components held in tension and compression. As a result of brace members 16, 16, lateral, compressive and tensile support is provided to leg members 12, 12.

Figure 2A:
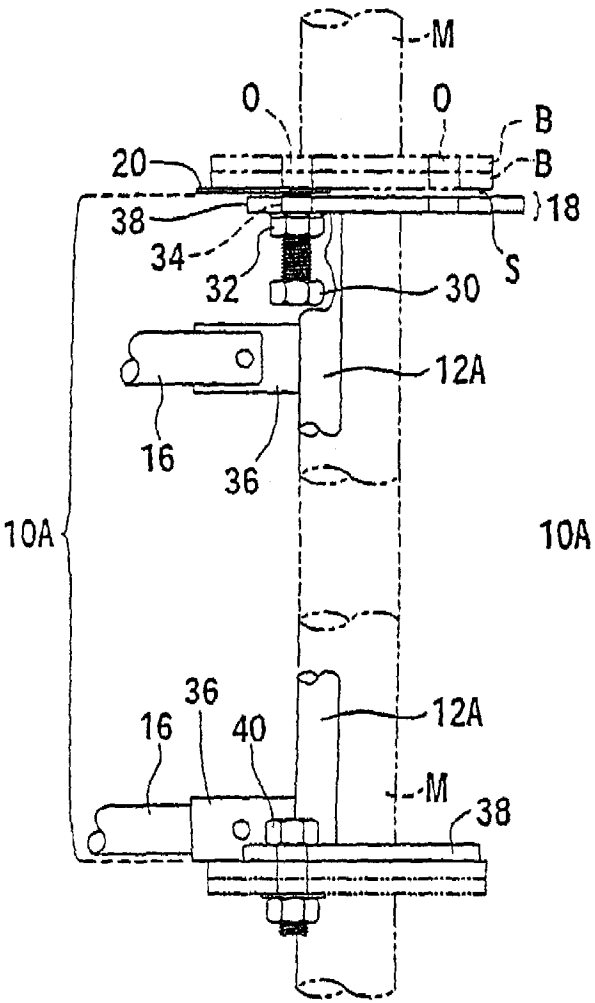
FIGS. 2A, 2B and 2C are elevated views of two splice connections of the section of the tower of FIG. 1 with an upper portion of a leg member of the apparatus of FIG. 1 only partially installed, with each figure showing the apparatus of FIG. 1 at a different stage of installation.
Figure 2B:
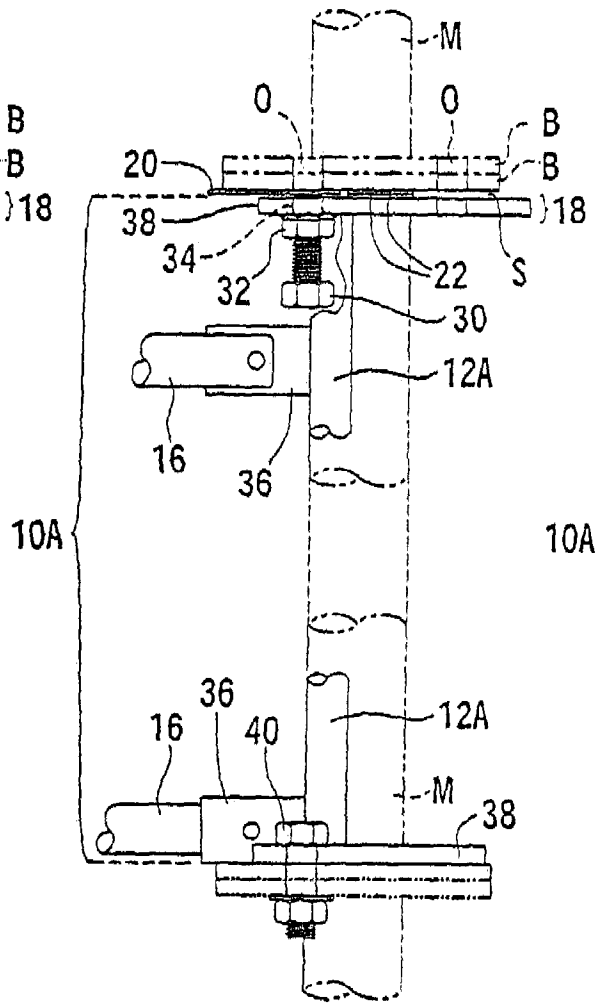
Figure 2C:
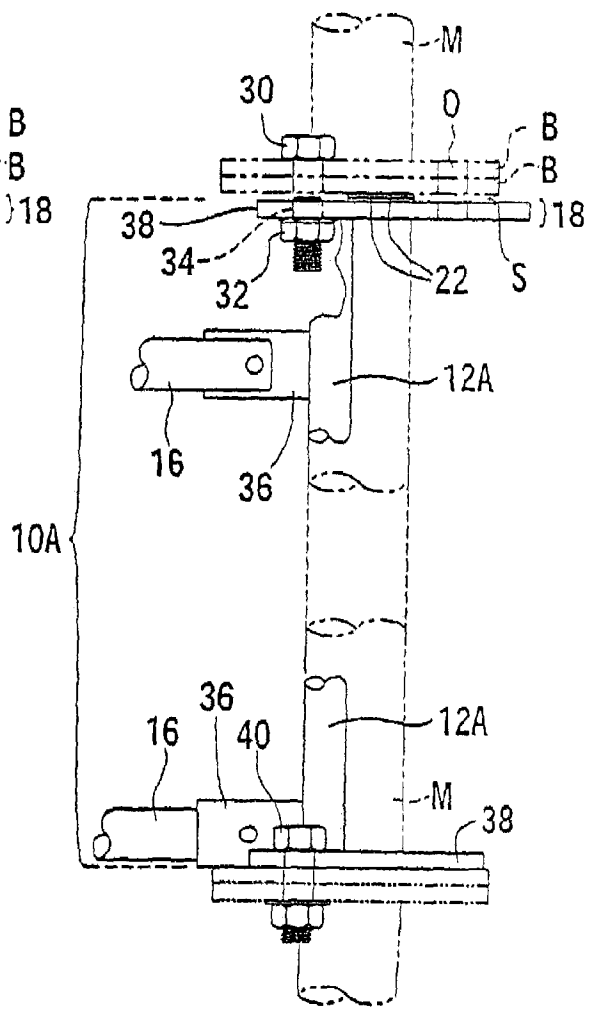

FIGS. 2A, 2B and 2C show magnified views of two splice connections of section A of the tower assembly with respective flange plates B, B. A portion of leg member 12A and vertical member M, respectively, have been cut away in each of these figures, leaving upper and lower portions of the respective members visible. In each of the FIGS. 2A, 2B and 2C, one less than the total number of tower flange bolts which hold flange plates B, B together on the upper portion of this face of tower section A have been removed leaving openings O, O. In each of these particular figures, panel 10A has been positioned in close proximity to section A of the tower assembly to be reinforced. The lower end of leg member 12A has been attached to the lower end of vertical member M using threaded flange bolts 40, 40. Leg member 12A has connecting plates 18, 18, here depicted as comprising linking elements 38, 38, attached to each end. At the upper end of leg member 12A, an opening 34 in linking element 38 is shown to be in proximity to and aligned with opening O. Nut 32, as shown, is welded to the lower surface of linking element 38 and in alignment with opening 34. Nut 32 may be attached by any conventional method, or may be integral with linking element 38. With particular reference to FIG. 2A, it can be seen that biasing means in the form of a threaded bolt 30 has been inserted through nut 32 and through opening 34 and is contacting a thrust plate 20 which has been inserted into the area between the top surface of linking element 38 and the lower surface of flange plate B so that thrust plate 20 covers opening O in flange plate B. As bolt 30 is tightened into nut 32, thrust plate 20 is biased away from linking element 38 and toward flange plate B so that a vertical space S is provided between the lower surface of flange plate B and the upper surface of linking element 38. This biasing action of tightening bolt 30 is believed to cause at least a portion of the load of tower section A to be transferred to leg member 12A of panel 10A. As may be seen in FIG. 2B, after vertical space S is provided, one or more shims 22, 22, sized and configured to fit into space S, are placed in vertical space S. Shims 22, 22 are typically left in place after attachment of connecting plate 18 to flange plate B, as seen in FIG. 2C, so that the partial load-shift from existing tower member M to leg member 12A can be maintained.

In addition to the threaded bolt depicted here, other non-limiting examples of suitable biasing means in the present invention could include levers, pistons and the like.

As may be seen from FIG. 2C, thrust plate 20 (shown only in FIGS. 2A and 2B) has been removed and bolt 30 has been removed and re-positioned so that bolt 30 is inserted through openings O, O in flange plates B, B, through vertical space S and tightened into nut 32. It is possible that bolt 30 as shown in FIG. 2C may or may not be the same as bolt 30 as shown in FIGS. 2A and 2B in terms of dimensions such as length.

The steps depicted in FIGS. 2A through 2C are repeated at the upper end of each leg member 12 in turn, as panel 10 is positioned, load is transferred from the load-bearing section of the tower to panel 10 and attachment of panel 10 to the load-bearing section of the tower is accomplished.

Figure 3:
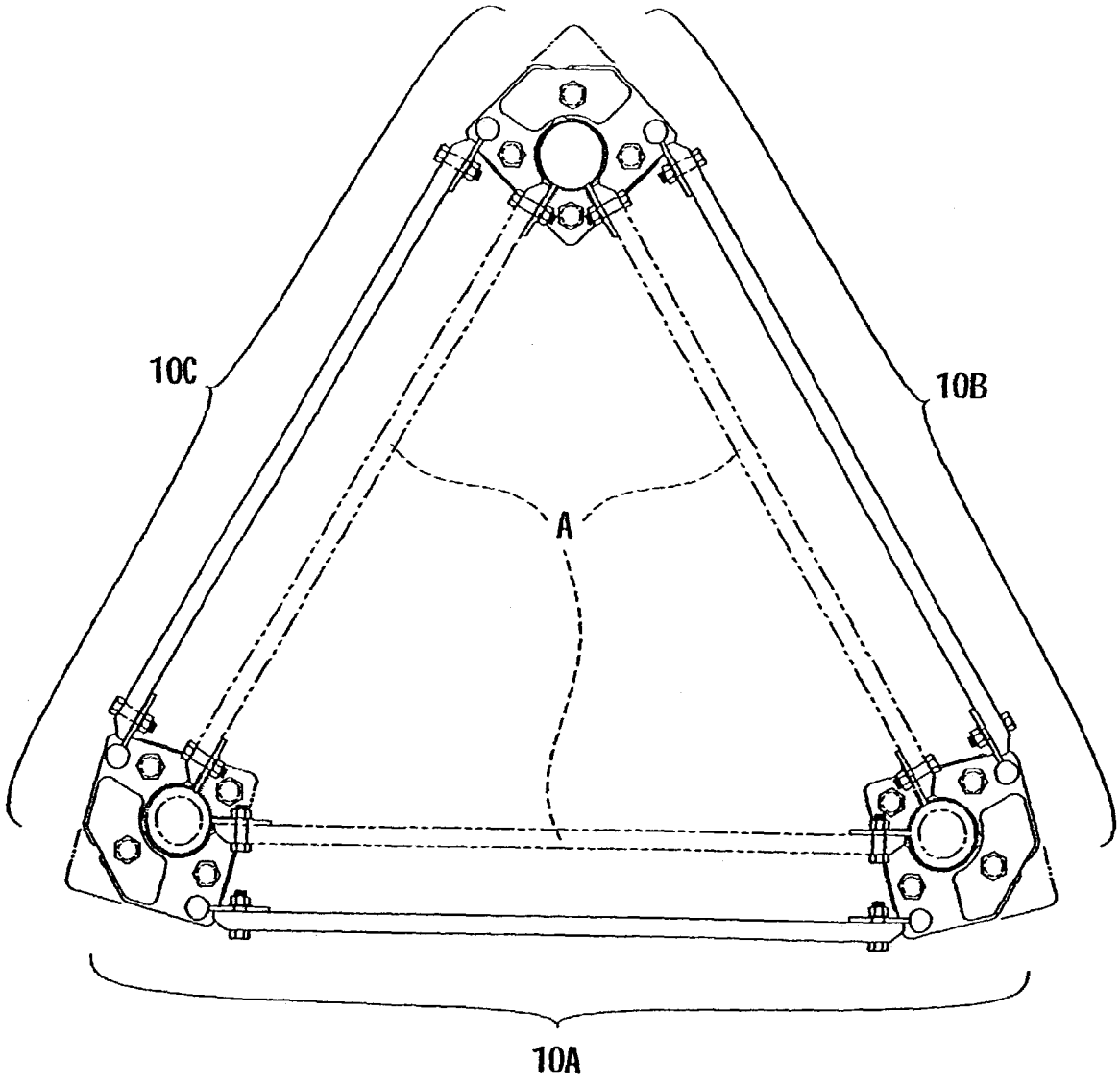
FIG. 3 is a cross-sectional view of the apparatus of FIG. 1 taken along lines 3—3 of FIG. 1.

FIG. 3 illustrates a cross-sectional view of tower A of FIG. 1 with panels 10A, 10B, 10C installed onto tower A. An embodiment of the invention provides that the panels of the invention are attached to respective sections of the tower assembly in a particular order. The transfer of load from tower A to panels 10A, 10B, 10C is accomplished substantially concurrently, with panels 10A, 10B, 10C being positioned, attached, and load transferred. Appropriate attachment of the various linking elements of the connection plates is accomplished in such a manner as to ensure that sufficient structural integrity is maintained at each splice connection. This means that a minimum number of bolts are removed as needed to accomplish the load transfer and attachment steps for each panel.

Figure 4A:
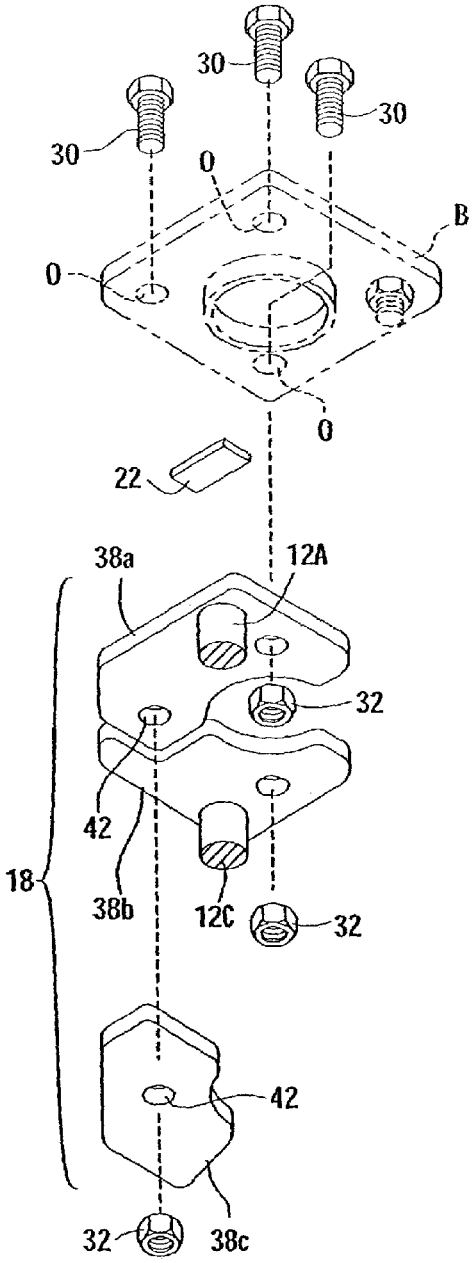
FIGS. 4A and 4B are exploded isometric views of components of the apparatus of FIG. 1.
Figure 4B:
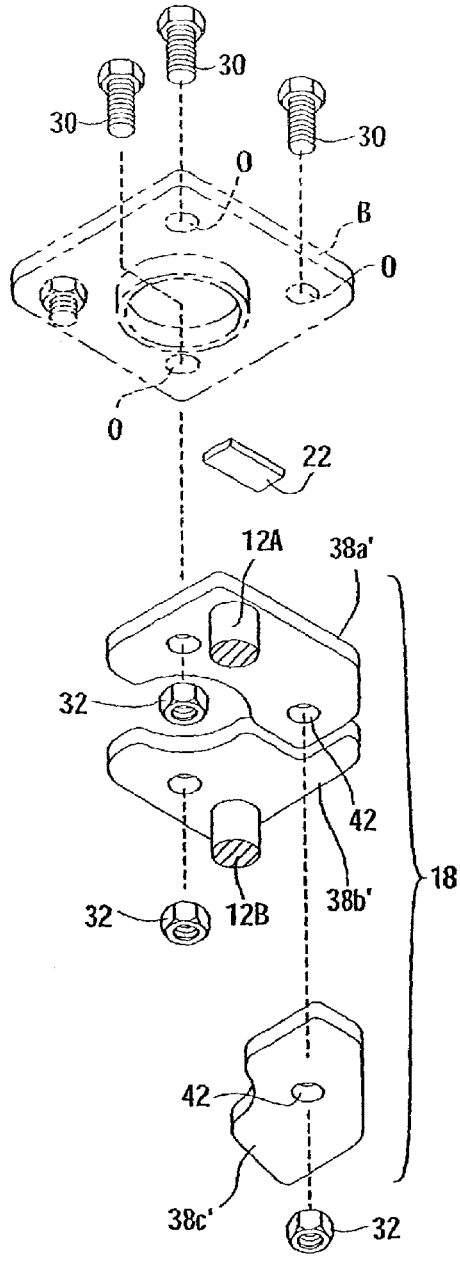

FIGS. 4A and 4B depict embodiments of the invention wherein connection plate 18 comprises linking elements 38*a*, 38*b*, 38*c* and 38*a*', 38*b*', 38*c*', respectively. As may be appreciated from consideration of these figures, each of the linking elements has a mirror image linking element for use with correlative panels. In FIG. 4A, linking element 38*a*, attached to leg member 12A, is sized and configured to cooperate with linking element 38*b*, attached to leg member 12C, to provide alignment and overlap with three of four openings O, O, O of flange plate B while substantially surrounding vertical member M of the tower assembly (shown in FIGS. 2A, 2B, and 2C). Linking element 38*c* abuts both linking element 38*a* and linking element 38*b* so as to join all three elements 38*a*, 38*b*, 38*c* into one effective connecting plate 18 after installation of two panels is complete. Shims 22, 22 are shown inserted between flange plate B and connecting plate 18 to provide continued biasing and compression of leg members 12A, 12B, 12C.

Linking element 38*c* is permanently attached to linking element 38*b* at their abutting surfaces by some appropriate means such as, but not limited to, by welding. Linking element 38*c* is attached to linking element 38*a* by alignment of bolt holes 42, 42 so that attachment is provided by bolt 30 and nut 32 during attachment of the apparatus of the invention to the tower assembly.

Figure 5:
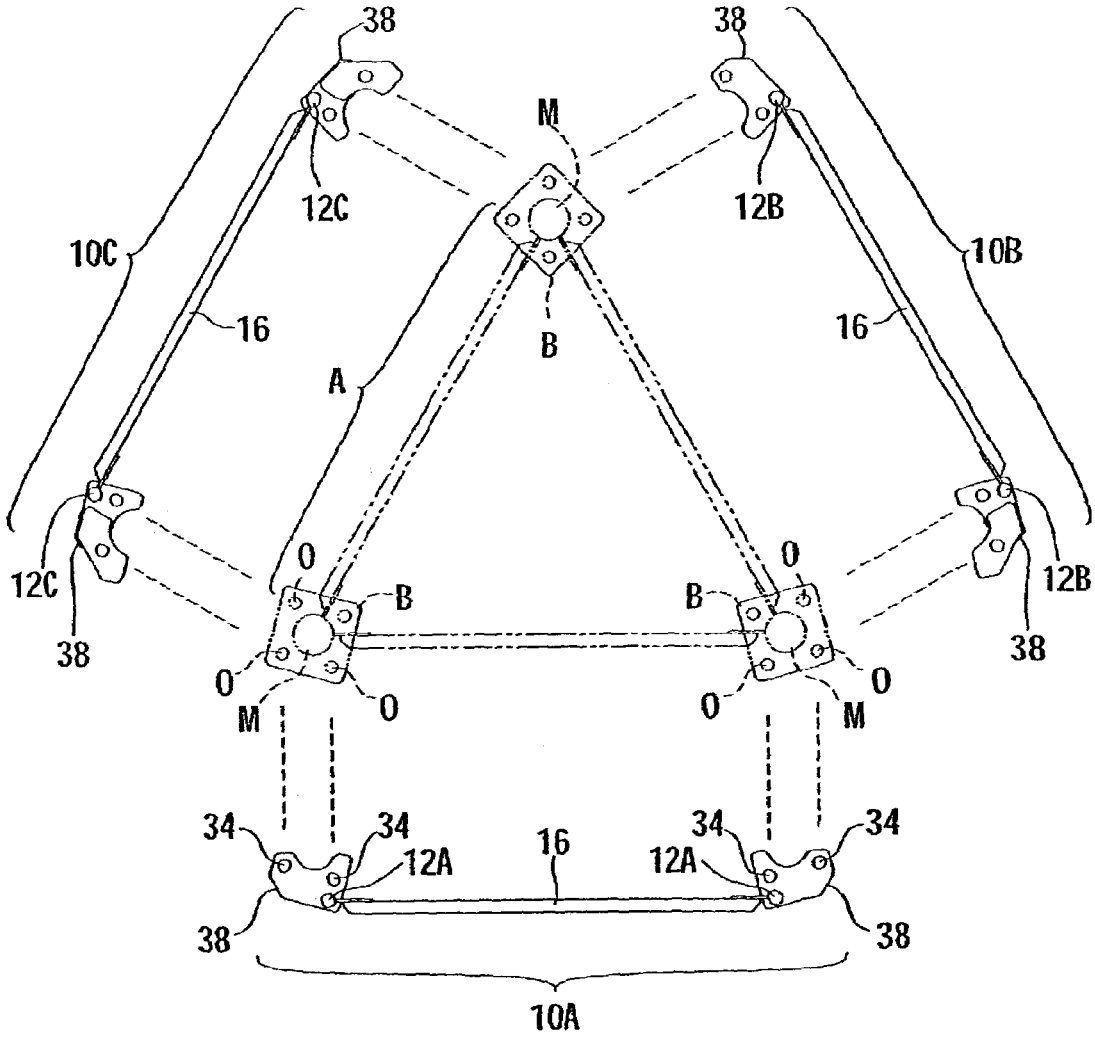
FIG. 5 is an exploded version of FIG. 3.

An embodiment of the invention is shown in cross-section in FIG. 5 where three panels 10A, 10B, 10C are positioned around tower assembly A preparatory to attachment thereto.

Figure 6:
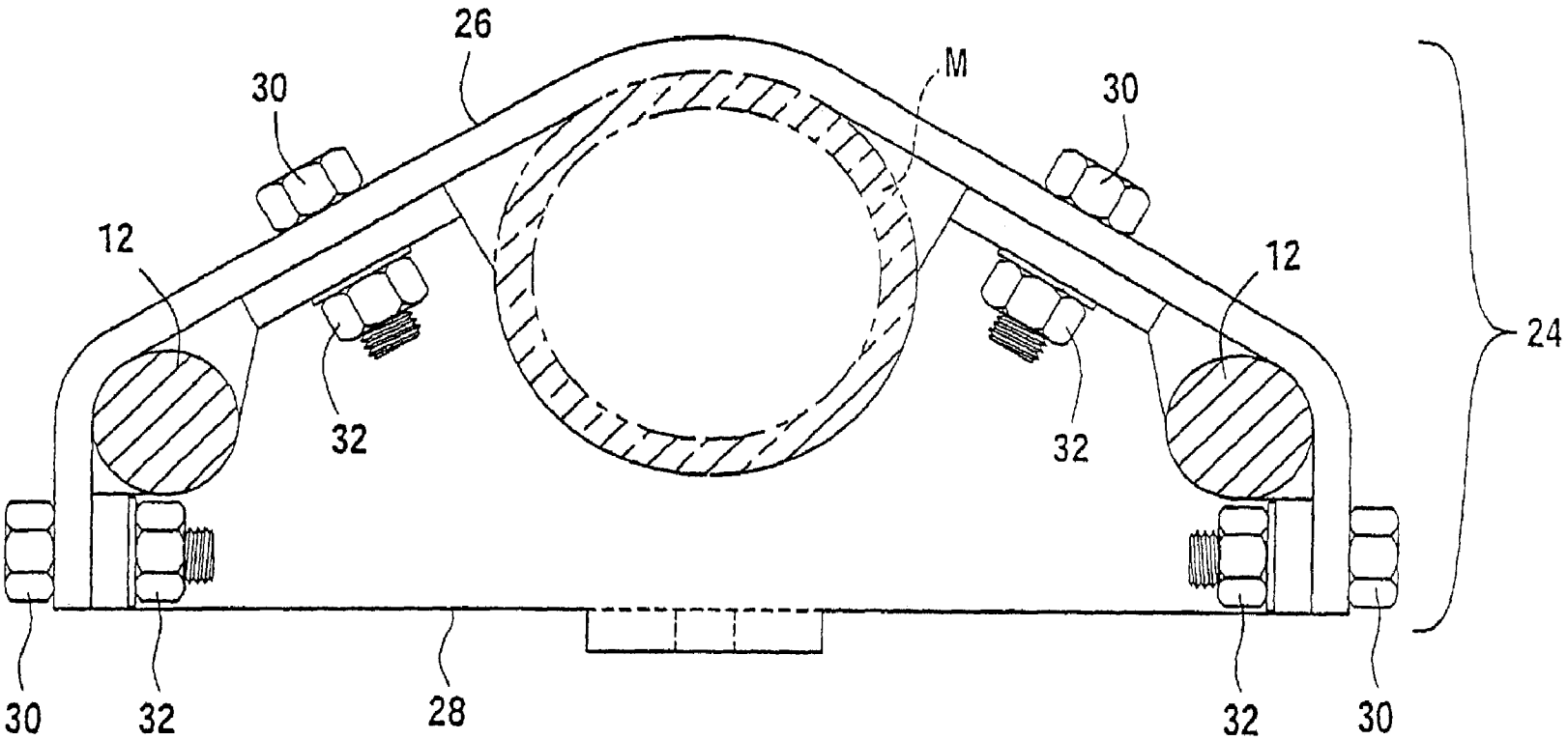
FIG. 6 is a top plan view of a support bracket of a preferred embodiment of this invention installed upon a vertical member of the tower and two leg members of the apparatus of FIG. 1, the vertical member and two leg members being shown in cross-section.

A feature of a preferred embodiment of the invention may be seen in FIG. 6 where a support bracket 24 is shown in cross-section attached to leg members 12, 12 and vertical member M of tower assembly A. Support bracket 24, as shown in this embodiment of the invention, comprises first bracket element 26 and second bracket element 28 which are sized and configured to unite leg members 12, 12 and vertical member M in a supporting relationship at any optional point along their respective lengths, further reinforcing existing tower assembly A. First bracket element 26 is joined to second bracket element 28 by use of threaded bolts 30, 30 and nuts 32, 32.

Figure 7:
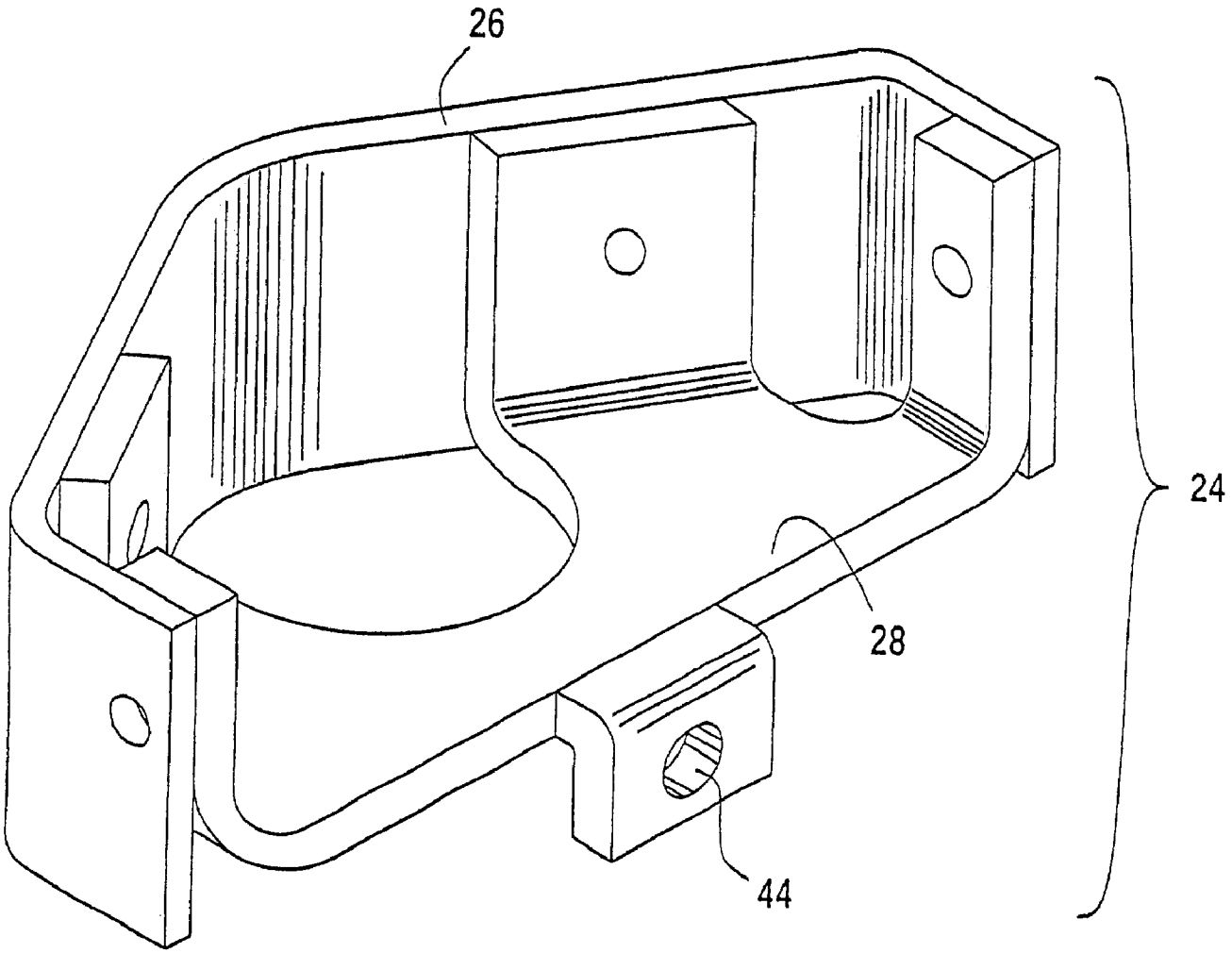
FIG. 7 is an isometric view of the support bracket of FIG. 6.

FIG. 7 shows an isometric view of support bracket 24 comprising first bracket element 26, second bracket element 28 and opening 44 in second bracket element 28. Opening 44 is sized and configured to allow optional attachment of a conventional guy wire (not shown). The guy wire can be passed through or attached to opening 44 so as to enable tension to be maintained on the guy wire after is has been anchored to the ground by any conventional manner as is known in the art.

Figure 8A:
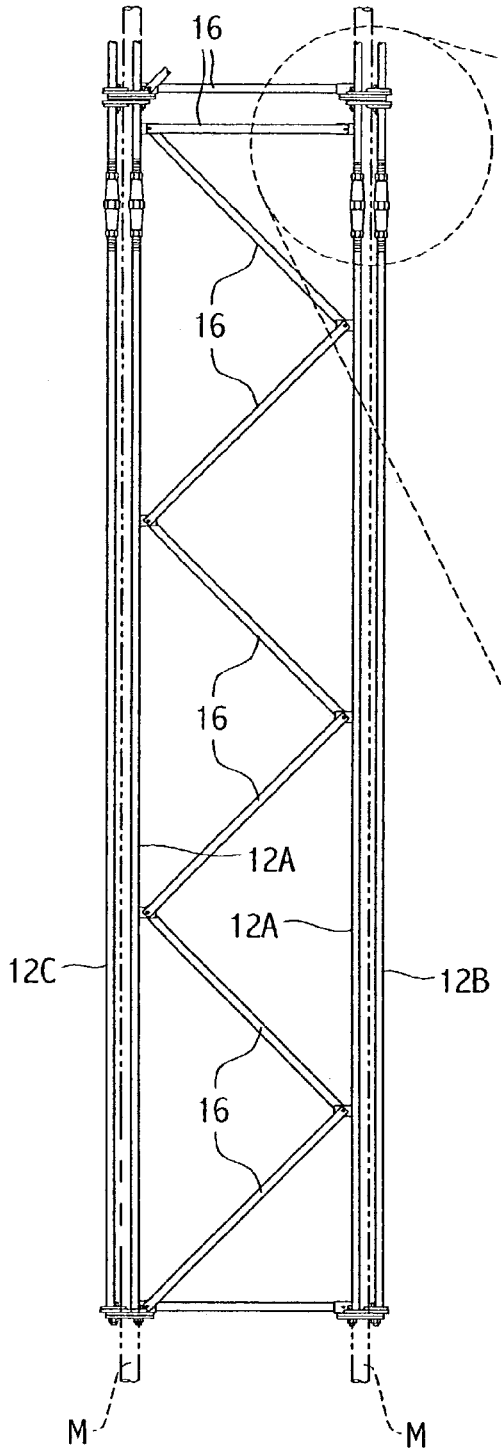
FIG. 8A is an elevated phantom view of a section of a guyed tower reinforced by another preferred embodiment of this invention.
Figure 8B:
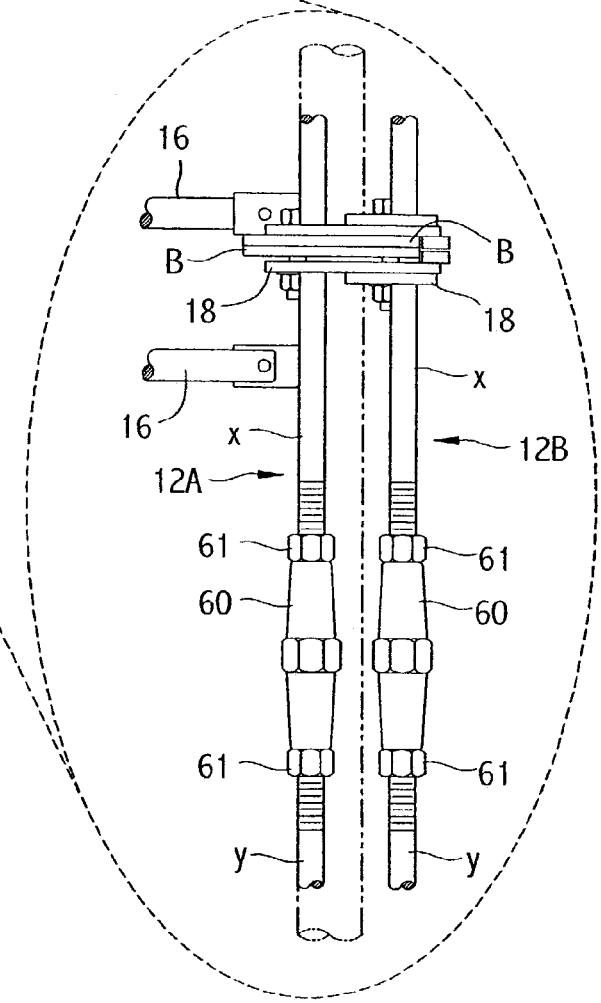
FIG. 8B is an enlarged view of the encircled area shown on FIG. 8A.

FIGS. 8A and 8B illustrate another embodiment of this invention, wherein the length of the support panels (only one panel illustrated in its entirety) is adjustable. In the embodiment depicted, each of the leg members (12A, 12A, 12B and 12C depicted) is comprised of a first leg portion x and a second leg portion y. The illustrated embodiment further comprises transfer means for transferring load from the supported section to the panel, the transfer means in the embodiment depicted being in the form of an intermediate threaded member in the form of threaded sleeve nut 60 and opposing locking nuts 61, the combination of which threadably receive and connect portions x and y of each leg, so that rotation of nut 60 enables adjustment of the overall length of the associated leg member by forcing leg portions x and y apart or bringing them together, depending upon the direction that sleeve nut 60 is rotated. Locking nuts 61 prevent subsequent changes in the threaded position of nut 60 relative to portions x and y after the desired length is achieved.

Figure 9A:
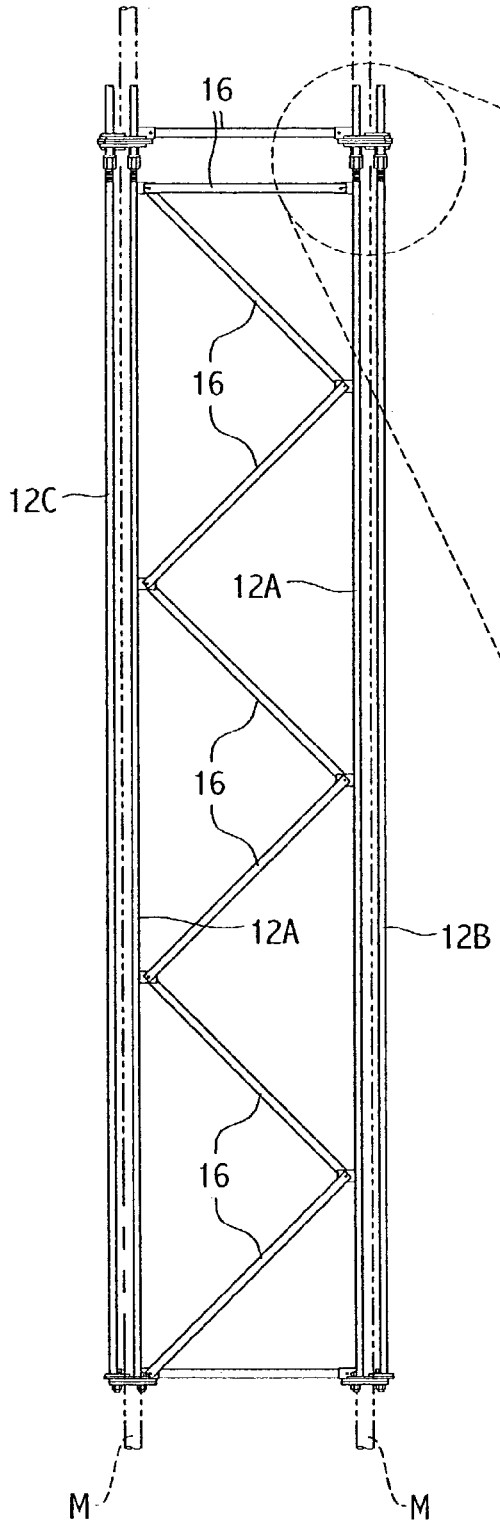
FIG. 9A is an elevated phantom view of a section of a guyed tower reinforced by another preferred embodiment of this invention.
Figure 9B:
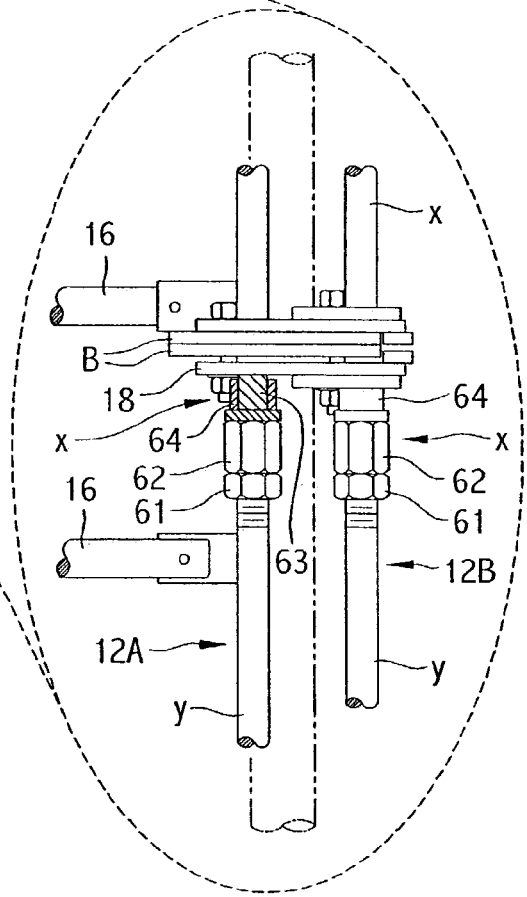
FIG. 9B an enlarged view of the encircled area shown on FIG. 9A.

FIGS. 9A and 9B illustrate yet another embodiment of this invention, wherein the length of the support panels (only two panels partially illustrated) is adjustable. In this embodiment, the transfer means for transferring load from the supported section to the panel is in the form of an intermediate threaded member in the form of a threaded receiving end portion 62 which is connected to, and may be integral with, portion x of each leg member, and is further comprised of a plurality of planed surfaces to form its outer surface in a similar fashion to a nut. An opposing end portion 64 of leg portion x which is opposite to receiving end portion 62 is configured to receive a stud-like portion 65 of connecting plate 18 in such a way that leg portion x may freely rotate relative to portion 65. End portion 62 threadably receives a threaded end of leg portion y so that when threaded receiving end portion 62 is rotated, the engagement of opposing end portion 64 and portion 65 with connecting plate 18 enables the overall length of the associated leg member to be adjusted while connecting plate 18 comes into contact with flange plate B, and for section load then to be transferred to the leg member when force is applied to the connecting plates by rotation of the intermediate threaded member. In order to insure that receiving end portion 62 remains in place when the desired position is achieved, locking nuts 61 are provided.

Neither of the embodiments depicted in FIGS. 8A–9B require the use of shims or specialized flanges to connect the leg member connecting plates to their respective section flange plates. Rather, these embodiments employ mechanisms which enable the adjustment of the overall length of the leg members (and therefore the overall length of the panels) while the connecting plates are in contact with or connected to the flange plates. Through this adjustment, the leg members become compressed by the gravitational forces incumbent upon the tower section, effectively transferring at least an appreciable amount of the section load to the panel leg members to thereby reinforce the tower section. The transfer means of the present invention can thus take one of several forms. Non-limiting examples of suitable transfer means for transferring at least a portion of the section load to the leg member include the depicted combination of a thrust plate and biasing means, mechanical devices connected to or integral with the leg members to make them adjustable in length, such as the alternatively depicted intermediate threaded member which threadably receives and connects the first and second leg portions, and the like.

A possible sequence of steps for installation of a plurality of panels of the invention in a step-wise manner allows for substantially concurrent transfer of load and application of compressive force to the panels. To accomplish this transfer of a portion of the load from the tower section to the panels, a plurality of panels is positioned around tower section to be reinforced and the panels are attached at the lower end of the leg members of the panels. Typically three of the four flange bolts for each tower flange plate are removed. In one embodiment of the present invention employing thrust plates and shims, the steps of inserting the thrust plates between the flange plate and the connecting plates, biasing the thrust plates away from the connecting plates and toward the flange plates, and providing vertical spaces between the flange plates and the connecting plates are carried out for each panel leg member in turn, moving around the tower section in either a clockwise or counterclockwise direction. Since the load transfer can be rapidly accomplished in relation to each leg member, partial load transfer can be accomplished in a substantially concurrent manner. After each leg member of the plurality of panels has been put under compression and load has been transferred, in one embodiment of the invention the concluding steps of inserting shims, removing the thrust plates and attaching the connecting plates to the respective flange plates are conducted to secure the plurality of panels to the section of the tower.

One or more support brackets may be used as needed to provide additional stability and connection of the panels of the invention to the tower assembly section to be reinforced. Provision of a site of guy wire attachment at the opening of the second bracket element expands the range of utility of the invention by enabling guyed tower assemblies where desired.

It is to be understood that when reference is made to a flange plate of the tower assembly, the flange plate can be an existing component of the structure of the tower as, for example, when tower sections are constructed with splice connections having abutting flange plates with matching bolt hole placements. These are the types of flange plates herein depicted. However, it is within the scope of this invention to install the claimed apparatus to a tower section having tubular legs where the splice connection between tower sections incorporates telescoping one leg into the other leg of the tower and joining the sections by aligning matching bolt holes, In the latter case, it is possible to adapt the tower support legs by, for example, attaching a flange plate at the splice connection site by clamping, bolting, welding or some other method of attachment. In this way, transfer of at least a portion of the load of the tower section can be accomplished by operation of the apparatus of this invention on the later-attached flange plate of the tower section. Thus, apparatus of this invention can reinforce tower sections having both types of splice connections and, in fact, can be used to reinforce tower sections which have any type of splice connection as long as a platform such as a flange plate can be provided for engaging the apparatus to the tower section.

Upon completion of assembly of all required panels all guy wire tension should be re-calibrated and the tower should be checked for twist and out-of-plumb per TIA/EIA-222-F or the most recent revision of the TIA/EIA Standard, Structural Standards for Steel Antenna Towers and Antenna Supporting Structures, or whatever engineering standard may be applicable.

As has been described herein, each component of the panels of the invention has been attached by bolted connection, however, welded or other types of connections may be appropriate depending on the design of the tower assembly to be reinforced. Apparatus of this invention requires no attachment to or augmentation of the existing diagonal and/or horizontal braces of the existing tower assembly and does not require welding to and/or drilling through the existing structure.

Leg members and brace members of the invention may be fabricated using any material capable of providing the requisite support. Preferably, they are made of a suitable metal or metal alloy with a cross-section which may be solid or hollow, round or polygonal, or any shape that is deemed appropriate for providing the desired level of support.

Shims which are inserted to occupy the vertical space provided between the flange plate of the tower assembly and the connecting plate can be fabricated of any suitably firm and sturdy material. It is possible that a jackscrew assembly can be used in the place of or in addition to such shims.

In addition to the claims presented hereinafter, and without limitation, the various embodiments of the present invention could be expressed in claim form as follows:

A. Apparatus for reinforcing one or more load-bearing sections of a tower assembly, the apparatus comprising:

(A) two leg members, (B) a plurality of brace members, sized and configured for connection to both of the leg members, and (C) at least one connecting plate sized and configured for attachment to a respective flange plate of the section of the tower assembly and for attachment to an end of the leg member, which flange plate is attached to or integral with the section of the tower assembly, the leg members, plurality of brace members and at least one connecting plate being sized and configured for attachment to one another to form a panel or a plurality of panels, such that the two leg members bear at least a portion of the section load when installed.

B. Apparatus according to claim A wherein the length of the panel is less than the length of the tower assembly section to be reinforced.

C. Apparatus according to claim B further comprising transfer means for transferring at least a portion of the section load to the leg member before attachment of the connecting plate to the flange plate of the tower assembly section.

D. Apparatus according to claim C wherein the transfer means comprises a thrust plate, sized and configured to slidably fit between the flange plate of the tower assembly and the connecting plate, which connecting plate is attached to the end of the leg member, and biasing means for biasing the thrust plate away from the connecting plate and toward the flange plate so that a vertical space is provided between the flange plate and the connecting plate, and such that at least a portion of the section load is placed on the leg member before attachment of the connecting plate to the flange plate of the tower assembly section.

E. Apparatus according to claim D further comprising one or more shims sized and configured to slidably fit between the flange plate of the tower assembly and the connecting plate, such that at least a portion of the section load can be maintained on the leg member during and after attachment of the connecting plate to the flange plate of the tower assembly section when the one or more shims is inserted into the space provided between the flange plate and the connecting plate.

F. Apparatus according to claim B further comprising one or more lateral support brackets attached to the leg members and to a vertical member of the section of the tower assembly.

G. Apparatus according to claim F wherein the bracket is sized and configured for attachment to a guy wire.

H. Apparatus according to claim E wherein the connecting plate comprises at least one linking element, sized and configured (i) to be attached to the end of the respective leg member, (ii) to be attached to the flange plate and (iii) to be attached to a corresponding linking element which is attached to the end of another respective leg member.

I. Apparatus according to claim H wherein the biasing means comprises a threaded bolt inserted through an opening in the connecting plate such that when the bolt is tightened, the vertical space is provided between the flange plate and the connecting plate and a portion of the section load is transferred to the leg member.

J. Apparatus according to claim 1 further comprising one or more lateral support brackets attached to the two leg members and to a vertical member of the section of the tower assembly.

K. Apparatus according to claim J wherein the bracket is sized and configured for attachment to a guy wire.

L. A method for reinforcing one or more load-bearing sections of a tower assembly, which method comprises:

(1) assembling a reinforcing panel having a vertical measure less than the vertical measure of the tower assembly section to be reinforced, which panel comprises (i) two leg members, (ii) a plurality of brace members sized and configured for connection to both of the leg members, and (iii) at least one connecting plate, sized and configured for attachment to a respective flange plate of the tower assembly and for attachment to an end of the leg member, which flange plate is attached to or integral with the section of the tower assembly, (2) positioning the panel in close proximity to a respective one of the one or more sections of the tower assembly, such that the connecting plate is adjacent to a flange plate of the respective section, (3) transferring at least a portion of the section load to each leg member, and (4) attaching the connecting plate to the flange plate.

M. A method according to claim L wherein step (3) is carried out by a process comprising:

(a) inserting a thrust plate between the flange plate and the connecting plate, (b) biasing the thrust plate away from the connecting plate and toward the flange plate so that a vertical space is provided between the flange plate and the connecting plate and at least a portion of the section load is placed on the leg member, (c) inserting one or more shims into the space provided between the flange plate and the connecting plate such that the one or more shims occupy essentially all of the vertical space, and (d) removing the thrust plate.

N. A method according to claim M wherein the thrust plate is biased using a threaded bolt inserted through an opening in the connecting plate such that when the bolt is tightened, the bolt contacts and moves the thrust plate to provide space between the flange plate and the connecting plate and at least a portion of the section load is placed on the leg member.

O. A method according to claim L further comprising attaching one or more lateral support brackets to the leg members and to a vertical member of the tower assembly.

P. A method according to claim O further comprising attaching an end of a guy wire to the lateral support bracket and anchoring another end of the guy wire to the ground so that tension in the guy wire is maintained.

Q. A method for reinforcing one or more load-bearing sections of a tower assembly, which method comprises:

(1) positioning a reinforcing panel having a vertical measure less the vertical measure of the tower assembly section to be reinforced, into close proximity to a flange plate of the section of the tower assembly, which panel comprises (i) two leg members, (ii) a plurality of brace members connected to and extending between both of the leg members, and (iii) a plurality of connecting plates, each plate connected to the end of a respective leg and sized and configured for attachment to a respective flange plate of the section of the tower assembly, which flange plate is attached to or integral with the section of the tower assembly, (2) positioning the panel in close proximity to the section of the tower assembly, such that the connecting plate is adjacent to a flange plate of the section of the tower assembly, (3) transferring at least a portion of the section load to each leg member, and (4) attaching the connecting plate to the flange plate.

R. A method according to claim Q wherein step (3) is carried out by a process comprising:

(a) inserting a thrust plate between the flange plate and the connecting plate, (b) biasing the thrust plate away from the connecting plate and toward the flange plate so that a vertical space is provided between the flange plate and the connecting plate and at least a portion of the section load is placed on the leg member, (c) inserting one or more shims into the space provided between the flange plate and the connecting plate such that the one or more shims occupy essentially all of the vertical space, and (d) removing the thrust plate.

S. A method according to claim R wherein the thrust plate is biased using a threaded bolt inserted through an opening in the connecting plate such that when the bolt is tightened, the bolt contacts and moves the thrust plate to provide space between the flange plate and the connecting plate and at least a portion of the section load is placed on the leg member.

T. A method according to claim Q further comprising attaching one or more lateral support brackets to the leg members and to a vertical member of the tower assembly.

U. A method according to claim T further comprising attaching an end of a guy wire to the lateral support bracket and anchoring another end of the guy wire to the ground so that tension in the guy wire is maintained.

V. A method for reinforcing one or more load-bearing sections of a tower assembly, which method comprises:

(A) attaching a respective support panel to each side of the one or more load-bearing sections at one or more respective flange plates, which flange plates are attached to or integral with the one or more tower sections, so that at least a portion of the load is transferred to the respective panel, and (B) attaching each of the respective support panels to one or more adjacent support panels.

W. In a tower assembly comprised of one or more of load-bearing tower sections, the improvement which comprises apparatus in accordance with claim 1 attached thereto.

X. In a tower assembly comprised of one or more of load-bearing tower sections, the improvement which comprises apparatus in accordance with claim C attached thereto.

Y. In a tower assembly comprised of one or more of load-bearing tower sections, the improvement which comprises apparatus in accordance with claim E attached thereto.

Z. In a tower assembly comprised of one or more of load-bearing tower sections, the improvement which comprises apparatus in accordance with claim H attached thereto.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

In the ensuing claims, means-plus-function clauses are intended to cover the structures described herein as performing the cited function and not only structural equivalents but also equivalent structures.

What is claimed is:

1. Apparatus for reinforcing at least one load-bearing section of all existing lattice tower assembly, which load-bearing section has a predetermined compression load, the apparatus comprising:

(A) two leg members each comprising a first leg portion and a second leg portion, (B) at least one brace member sized and configured for connection to both of the leg members, and (C) at least one connecting plate sized and configured for attachment to a respective flange plate of the section of the tower assembly and for attachment to an end of one of the leg members, the flange plate being attached to or integral with the section of the tower assembly, wherein the leg members, at least one brace member and at least one connecting plate are sized and configured to form a reinforcing panel which is attachable to the load-bearing section of the tower assembly, so that the two leg members bear at least a portion of the compression load when the panel is attached to the load-bearing section of the tower assembly, transfer means comprising, for each leg member, an intermediate threaded member which threadably receives and connects the first and second leg portions, so that rotation of the intermediate threaded member enables vertical adjustment of the length of the associated leg member, and wherein the transfer means transfers at least a portion of the compression load from the at least one load-bearing section to the leg members so that the at least one load-bearing section has a compression load that is lower than the predetermined compression load.

2. Apparatus according to claim 1 wherein the length of the panel is adjustable.

3. Apparatus according to claim 2 further comprising one or more lateral support brackets attached to the leg members and to a vertical member of the section of the tower assembly.

4. Apparatus according to claim 3 wherein the bracket is sized and configured for attachment to a guy wire.

5. Apparatus according to claim 1 wherein the connecting plate comprises at least one linking element, sized and configured (i) to be attached to the end of the respective leg member, (ii) to be attached to the flange plate and (iii) to be attached to a corresponding linking element which is attached to an end of another respective leg member.

6. Apparatus according to claim 5 further comprising one or more lateral support brackets attached respectively to the leg members, and attached respectively to a vertical member of the section of the tower assembly.

7. Apparatus according to claim 6 wherein the bracket is sized and configured for attachment to a guy wire.

8. Apparatus according to claim 1 wherein the at least one connecting plate comprises four connecting plates attached respectively to each end of each leg member.

9. A method for reinforcing one or more load-bearing sections of an existing lattice tower assembly, which load-bearing sections each have a predetermined compression load, which method comprises:

(1) assembling a reinforcing panel having an adjustable vertical measure which may be less than the vertical measure of the tower assembly section to be reinforced, which panel comprises (i) two leg members, each comprising a first leg portion and a second leg portion and an intermediate threaded member which threadably receives and connects the first and second leg portions, (ii) at least one brace member sized and configured for connection to both of the leg members, and (iii) at least one connecting plate, sized and configured for attachment to a respective flange plate of the tower assembly and for attachment to an end of the leg member, which flange plate is attached to or integral with the section of the tower assembly, (2) positioning the panel in close proximity to a respective one of the one or more sections of the tower assembly, such that the connecting plate is adjacent to a flange plate of the respective section, (3) lengthening the panel, such that for each leg member, the intermediate threaded member is rotated to vertically adjust the length of the associated leg member, and transfer at least a portion of the compression load from the one or more load-bearing sections to the leg members so that the one or more load-bearing sections have a compression load that is lower than the predetermined compression load, and (4) attaching the connecting plate to the flange plate.

10. A method according to claim 9 wherein step (3) is carried out by a process comprising, with respect to each of the leg members, lengthening the leg member by rotating an intermediate threaded member of the leg member, which intermediate threaded member connects a first leg portion to a second leg portion, the lengthening continuing until a desired amount of load has been transferred to each of the leg members.

11. A method according to claim 10 further comprising attaching one or more lateral support brackets to one or more of the leg members and to a vertical member of the tower assembly.

12. A method according to claim 11 further comprising attaching an end of a guy wire to the lateral support bracket and anchoring another end of the guy wire to the ground so that tension in the guy wire is maintained.

13. A method for reinforcing one or more load-bearing sections of an existing lattice tower assembly, which load-bearing sections each have a predetermined compression load, which method comprises:

(1) positioning a reinforcing panel having an adjustable vertical measure which may be adjusted to be less than the vertical measure of the tower assembly section to be reinforced, into close proximity to a flange plate of the section of the tower assembly, which panel comprises (i) two leg members, each comprising a first leg portion and a second leg portion and an intermediate threaded member which threadably receives and connects the first and second leg portions, (ii) a plurality of brace members connected to and extending between both of the leg members, and (iii) a plurality of connecting plates, each plate connected to the end of a respective leg and sized and configured for attachment to a respective flange plate of the section of the tower assembly, which flange plate is attached to or integral with the section of the tower assembly, (2) positioning the panel in close proximity to the section of the tower assembly, such that the connecting plate is adjacent to a flange plate of the section of the tower assembly, (3) transferring at least a portion of the compression load to each leg member by rotating the intermediate threaded member of each leg member to vertically adjust the length of each leg member, and transfer at least a portion of the compression load from the one or more load-bearing sections to the leg members so that the one or more load-bearing sections have a compression load that is lower than the predetermined compression load, and (4) attaching the connecting plates to their respective flange plates.

14. A method according to claim 13 wherein step (3) is carried out by a process comprising, with respect to each of the leg members, lengthening the leg member by rotating an intermediate threaded member of the leg member, which intermediate threaded member connects a first leg portion to a second leg portion, the lengthening continuing until a desired amount of load has been transferred to each of the leg members.

15. A method according to claim 14 further comprising attaching one or more lateral support brackets to one or more of the leg members and to a vertical member of the tower assembly.

16. Original) A method according to claim 15 further comprising attaching an end of a guy wire to one of the lateral support brackets and anchoring another end of the guy wire to the ground so that tension in the guy wire is maintained.

17. A method for reinforcing one or more load-bearing sections of an existing lattice tower assembly, which load-bearing sections each have a predetermined compression load, which method comprises:

(A) attaching a respective adjustable-length reinforcing panel to each side of the one or more load-bearing sections at one or more respective flange plates, which panel comprises (i) two leg members, each comprising a first leg portion and a second leg portion and an intermediate threaded member which threadably receives and connects the first and second leg portions, (ii) a plurality of brace members connected to and extending between both of the leg members, and (iii) a plurality of connecting plates, each plate connected to the end of a respective leg and sized and configured for attachment to a respective flange plate of the section of the tower assembly, which flange plate is attached to or integral with the section of the tower assembly, which flange plates are attached to or integral with the one or more load-bearing sections, so that at least a portion of the compression load is transferred from the load-bearing sections to the respective panel so that the load-bearing section have a compression load that is lower than the predetermined compression load, and (B) attaching each of the respective adjustable-length reinforcing panels to one or more adjacent adjustable-length reinforcing panels.

* * * * *